US005307548A

United States Patent [19]

Engel

[11] Patent Number: 5,307,548

[45] Date of Patent: May 3, 1994

[54] A METHOD OF FORMING TAPERED CHANNELS FOR SCISSORS JACK

[75] Inventor: Darryl L. Engel, LaOtto, Ind.

[73] Assignee: Universal Tool & Stamping Company, Inc., Butler, Ind.

[21] Appl. No.: 40,994

[22] Filed: Mar. 31, 1993

[51] Int. Cl.[5] ..... B21D 31/04

[52] U.S. Cl. ..... 29/6.1; 29/559; 29/897; 72/379.2

[58] Field of Search ..... 29/6.1, 163.6, 897, 29/559, DIG. 37; 72/379.2, 377, 378

[56] References Cited

U.S. PATENT DOCUMENTS

| | | | |
|---|---|---|---|
| 1,531,290 | 3/1925 | Lochhead et al. | 29/6.1 |
| 1,901,915 | 6/1930 | Loughridge . | |
| 2,023,410 | 2/1935 | Davis et al. . | |
| 3,740,812 | 6/1973 | Ryan | 29/6.1 X |
| 4,017,936 | 4/1977 | Schweikert | 72/379.2 X |
| 4,487,053 | 12/1984 | Bauer et al. | 72/379.2 X |
| 4,545,170 | 10/1985 | Shirey | 29/6.1 X |
| 5,064,171 | 11/1991 | Engel | 254/126 |

FOREIGN PATENT DOCUMENTS

| | | | |
|---|---|---|---|
| 2078276 | 1/1982 | United Kingdom | 72/379.2 |

*Primary Examiner*—Mark Rosenbaum
*Assistant Examiner*—S. Thomas Hughes
*Attorney, Agent, or Firm*—Hill, Steadman & Simpson

[57] ABSTRACT

A method of forming a tapered channel for a jack which uses less material comprising forming curved openings in the center portion of the channel and then stretching the middle portion of the channel so that it is tapered to produce a tapered channel.

4 Claims, 1 Drawing Sheet

A METHOD OF FORMING TAPERED CHANNELS FOR SCISSORS JACK

CROSS-REFERENCES TO RELATED APPLICATIONS

This application is related to application entitled "Jack Design With Tapered Channel Formed By Thinning Material", assigned to the assignee of the present invention in which the inventor is Darryl L. Engel, and identified as U.S. patent application Ser. No. 08/043,208, filed Apr. 5, 1993.

BACKGROUND OF THE INVENTION

Field of the Invention

This invention relates in general to scissors jacks and in particular to a novel method of manufacturing a jack with tapered channels with decreased material scrap.

Description of Related Art

In some jack designs, such as scissors jacks, it is desired to use tapered channels. When a tapered channel is compared to a straight channel, the weight of a part increases and the percentage of scrap in the blank also increases. This generally increases the cost of producing tapered channels. See also U. S. Pat. Nos. 2,023,410 and 1,901,915, 1,780,265, 3,317,187, 3,353,790 and 5,064,171.

SUMMARY OF THE INVENTION

It is an object of the present invention to produce a tapered channel without increasing the weight and the scrap loss as occurs in the prior art.

It is a feature of the invention that a blank which has the size of a normal straight channel is utilized and a plurality of cutouts in the back of the channel are formed after which the channel is stretched into a tapered form. The cutouts allow the back of the channel to be easily tapered and also reduce the weight of the member due to the cutouts. The invention allows blanks to be used for tapered forms which are no larger than straight blanks of the prior art.

It is an object of the invention to provide an improved taper channel for a scissors jack.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, and in which:

DETAILED DESCRIPTION OF THE PREFERRED EMBODIMENTS

Figure 1:
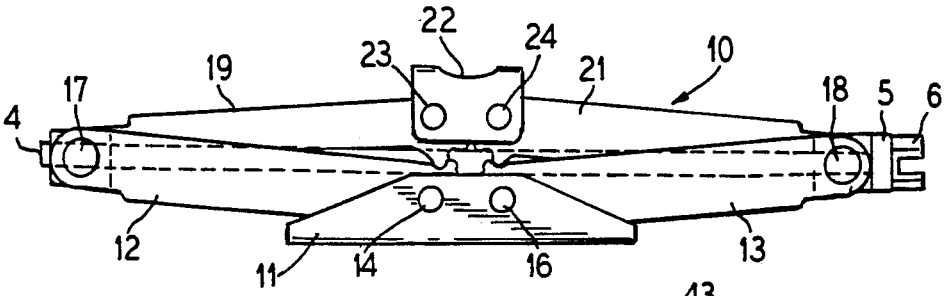
FIG. 1 is a side plan view of a scissors jack.

FIG. 1 is a side plan view of a scissors jack in which the tapered channel of the present invention can be utilized. The jack 1 0 has a base 1 1 which is pivotally connected to lower channel members 12 and 13 by pivot pins 14 and 16. A threaded trunnion 17 pivotally connects the upper end of channel 12 to the lower end of an upper channel member 19. A plane trunnion 18 pivotally connects the end of channel 13 to the end of an upper channel 21. A support 22 is pivotally connected by pivot pins 23 and 24 to the ends of the channels 19 and 21. A lead screw 4 extends through the threaded trunnion 14 and the plane trunnion 18 and has a handle attachment 6 into which a handle can be inserted for raising and lowering the jack. A bearing 5 is mounted between the trunnion 18 and the portion 6 as shown. The ends of the channels 12 and 13 are provided with gear teeth which intermesh and the ends of channels 19 and 21 are provided with gear teeth which intermesh.

Figure 2:
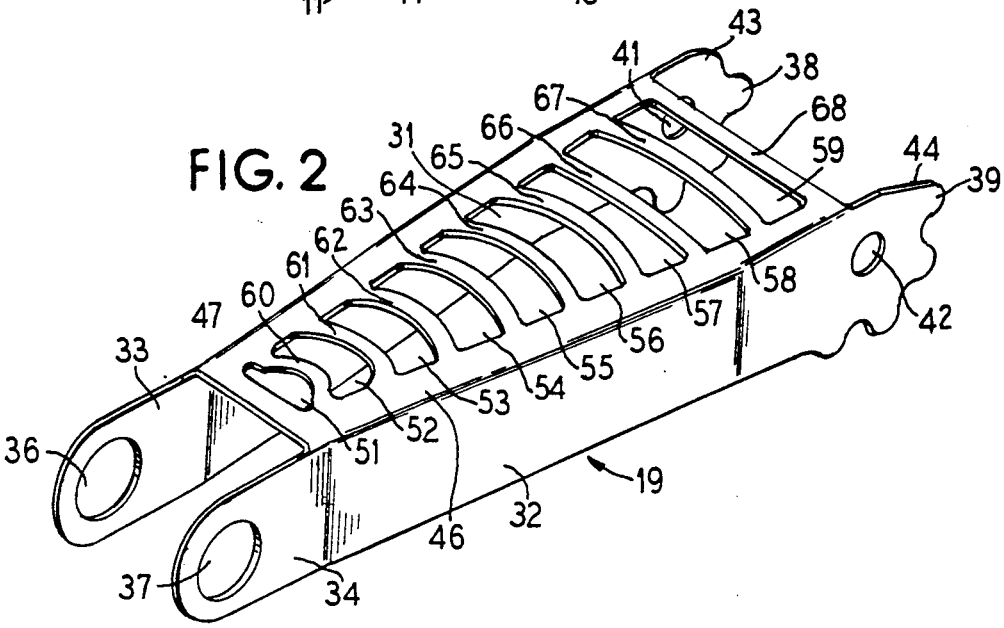
FIG. 2 is a perspective view of a tapered channel.

FIG. 2 illustrates a tapered channel member such as the channel member 12 or 19, 13 or 21. The channel member 19 is illustrated which has downwardly extending sides 31 and 32. End portions 33 and 34 of the sides 31 and 32 are formed with openings 36 and 37 for receiving the trunnion therethrough. The other ends 43 and 44 are formed with gear teeth 38 and 39 and are provided with openings 41 and 42 for receiving pivot pins.

Figure 3:
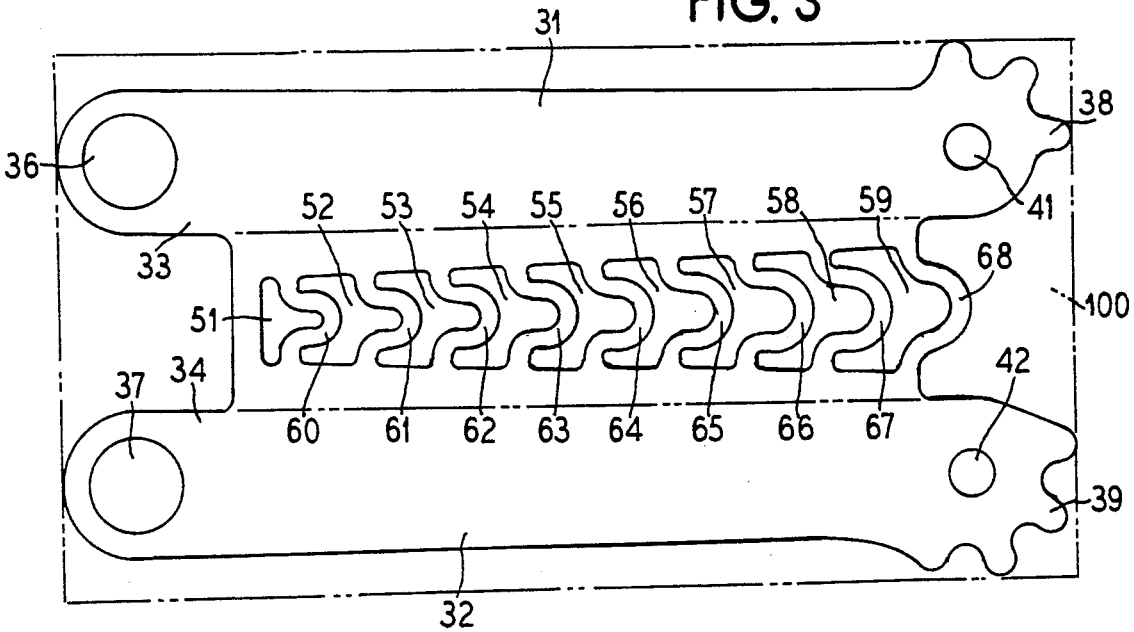
FIG. 3 is a plan view illustrating the blank for a tapered channel.

As shown in FIG. 3, a channel 19 can be made from a blank 100 by providing openings 51, 52, 53, 54, 55, 56, 57, 58 and 59 which provide curved metal strap portions 60, 61, 62, 63, 64, 65, 66, 67 and 68 adjacent the openings. The openings 36, 37, 41 and 42 and the gear teeth 38 and 39 are also stamped from the blank 100. Then the blank is placed into a machine which clamps it and pulls outwardly on the ends of the channel members that have the gear teeth 38 and 39 so that the strap members 60, 61, 62, 63, 64, 65, 66, 67 and 68 become substantially straight so that they have the shapes shown in FIG. 2. Either before or after stretching the top of the channel member, the sides 31 and 32 are bent at right angles to the top as shown in FIG. 2.

The method of the invention allows a tapered channel to be formed from a blank 100 which has a smaller size than blanks that have been required to form tapered channels in the prior art. This is because by cutting the holes 51 through 59 and stretching the top portion to form the structure shown in FIG. 2 requires less metal than the prior art devices. The openings 51 through 59 may have various shapes and the number of openings may vary.

The jack is assembled from four channel members as shown in FIG. 1.

Although the invention has been described with respect to preferred embodiments, it is not to be so limited as changes and modifications can be made therein which are within the full intended scope as defined by the appended claims.

I claim as my invention:

1. A method of forming a tapered channel for scissors jacks, comprising the steps of cutting from a rectangular blank a channel form which has first and second sides and a center portion, forming a plurality of adjacent openings in said center portion which are separated by curved strap portions, clamping said first and second sides and pulling said first and second sides apart so as to form said center portion into a tapered form, and bending said first and second sides so that they are at right angles to said center portion.

2. The method of forming a tapered channel according to claim 1 wherein said first and second sides are bent before said center portion is formed into a tapered form.

3. The method of forming a tapered channel according to claim 1 wherein said first and second sides are bent after said center portion has been formed into a tapered form.

4. The method of claim 1 wherein said curved strap portions increase in length as said tapered center portion increases in width.

* * * * *